US009695779B2

(12) United States Patent
Wilkinson et al.

(10) Patent No.: US 9,695,779 B2
(45) Date of Patent: Jul. 4, 2017

(54) EXHAUST GAS MIXING SYSTEM

(71) Applicant: Perkins Engines Company Limited, Peterborough, Cambridgeshire (GB)

(72) Inventors: Paul Wilkinson, Peterborough (GB); Jean-Yves Tillier, Peterborough (GB)

(73) Assignee: Perkins Engines Company Limited, Peterborough (GB)

( * ) Notice: Subject to any disclaimer, the term of this patent is extended or adjusted under 35 U.S.C. 154(b) by 51 days.

(21) Appl. No.: 14/618,429

(22) Filed: Feb. 10, 2015

(65) Prior Publication Data

US 2015/0240753 A1 Aug. 27, 2015

(30) Foreign Application Priority Data

Feb. 24, 2014 (GB) ..... 1403181.9

(51) Int. Cl.
*F02M 25/07* (2006.01)
*F02M 26/12* (2016.01)
*F02M 26/19* (2016.01)

(52) U.S. Cl.
CPC ..... *F02M 25/0722* (2013.01); *F02M 26/12* (2016.02); *F02M 26/19* (2016.02)

(58) Field of Classification Search
CPC ..... F02M 25/07; F02M 25/0703; F02M 25/0704; F02M 25/0707; F02M 25/0715; F02M 25/0719; F02M 25/0722; F02M 25/0724
USPC ..... 123/184.21, 184.25, 184.44, 184.51, 123/567.11, 568.15, 568.17, 217
See application file for complete search history.

(56) References Cited

U.S. PATENT DOCUMENTS 7,552,722 B1 * 6/2009 Shieh ..... 123/568.17
7,568,340 B2 * 8/2009 Marsal ..... 123/568.17
2006/0060173 A1 * 3/2006 Wei ..... F02B 29/0425 123/568.17
2009/0165756 A1 * 7/2009 Shieh ..... B01F 3/02 123/568.17
2010/0122693 A1 * 5/2010 Braun ..... F02M 35/10222 123/568.17
2011/0061634 A1 * 3/2011 Sponsky ..... F02B 47/08 123/568.17
2011/0088673 A1 * 4/2011 Kapala ..... F02M 35/10262 123/568.17
2011/0209772 A1 9/2011 Woiken et al.
(Continued)

FOREIGN PATENT DOCUMENTS

DE 102009052319 A1 5/2011
JP 09-195859 A 7/1997

OTHER PUBLICATIONS

United Kingdom Intellectual Property Office, Search Report in United Kingdom Patent Application No. GB1403181.9, Sep. 19, 2014, 1 p.

*Primary Examiner* — John Kwon
*Assistant Examiner* — Johnny H Hoang

(57) ABSTRACT

The present disclosure relates to a mixing chamber for mixing exhaust gas with intake air in an engine. The mixing chamber has an intake air inlet, an exhaust gas inlet and a mixing post. The mixing post is located downstream of the charge air inlet and upstream of a point where the flow of exhaust gas meets the flow of intake air, the mixing post extending across the mixing chamber. The mixing post has a longitudinal axis which is oriented perpendicular to a longitudinal axis of the mixing chamber.

17 Claims, 3 Drawing Sheets

(56) References Cited

U.S. PATENT DOCUMENTS

| | | | | |
|---|---|---|---|---|
| 2012/0048246 | A1* | 3/2012 | Takagi | 123/568.15 |
| 2013/0081601 | A1* | 4/2013 | Martins | F02M 35/10222 123/568.12 |
| 2014/0020382 | A1* | 1/2014 | Subramanian | F02B 29/0406 60/605.2 |

* cited by examiner

EXHAUST GAS MIXING SYSTEM

CROSS-REFERENCE TO RELATED APPLICATIONS

This patent application claims the benefit of United Kingdom Patent Application No. 1403181.9, filed Feb. 24, 2014, which is incorporated by reference.

TECHNICAL FIELD

The present disclosure relates to an exhaust gas mixing system suitable for use in an exhaust gas recirculation system of an internal combustion engine.

BACKGROUND

Exhaust gas recirculation (EGR) is a known technique for use in internal combustion engines (petrol or diesel) wherein a portion of an engine's exhaust gas is recirculated back to the engine cylinders and mixed with the flow of intake air. EGR may be used to reduce emissions of undesirable pollutant gases, such as nitrous oxides including NO and $NO_2$, and particulates, such as soot.

A typical EGR system may include a conduit, or other structure, fluidly connecting a portion of the exhaust path of an engine with a portion of the air intake system of the engine, thereby forming an EGR path. The exhaust gas and intake air need to be sufficiently well mixed to provide an even concentration of the exhaust gas in the intake air to enable the reduction of emissions, in particular nitrous oxides.

An EGR mixer module may be used to effect the mixing of the exhaust gas and intake air and which may be configured to mix the intake air together with the EGR gas to create a mixture having a desirable level of homogeneity. The EGR mixer module may simply be a conduit and/or the intake manifold, which may be provided with features such as for example vanes, valves, or labyrinths to increase the mixing characteristics if desired. In some embodiments the EGR mixer module may include a dedicated fluid mixer assembly.

WO 2009/149868 describes an exhaust gas mixing system having a mixing module comprising a tube with a number of apertures through which the exhaust gas flows to be distributed into the air intake channel.

SUMMARY OF THE DISCLOSURE

The present disclosure provides mixing chamber for mixing exhaust gas with charge air in an engine, said mixing chamber comprising:

an intake air inlet configured to receive a flow of intake air;

an exhaust gas inlet located downstream of the intake air inlet and configured to receive a flow of exhaust gas; and a mixing post located downstream of the intake air inlet and upstream of a point where at least a portion of the exhaust gas meets the intake air, said mixing post extending across the mixing chamber, said mixing post having a longitudinal axis which is oriented perpendicular to a longitudinal axis of the mixing chamber.

The present disclosure further provides a mixer module for mixing exhaust gas with charge air in an engine, the mixer module comprising:

an intake air inlet configured to receive a flow of intake air;

an exhaust gas inlet located downstream of the charge air inlet and configured to receive a flow of exhaust gas;

an outlet; and a mixing chamber as described above which extends from the intake air inlet to the outlet.

The present disclosure further provides an internal combustion engine comprising the mixer module as described above.

BRIEF DESCRIPTION OF THE DRAWINGS

Embodiments of the present disclosure will now be described, by way of example only, with reference to the accompanying drawings, in which.

DETAILED DESCRIPTION

Figure 1:
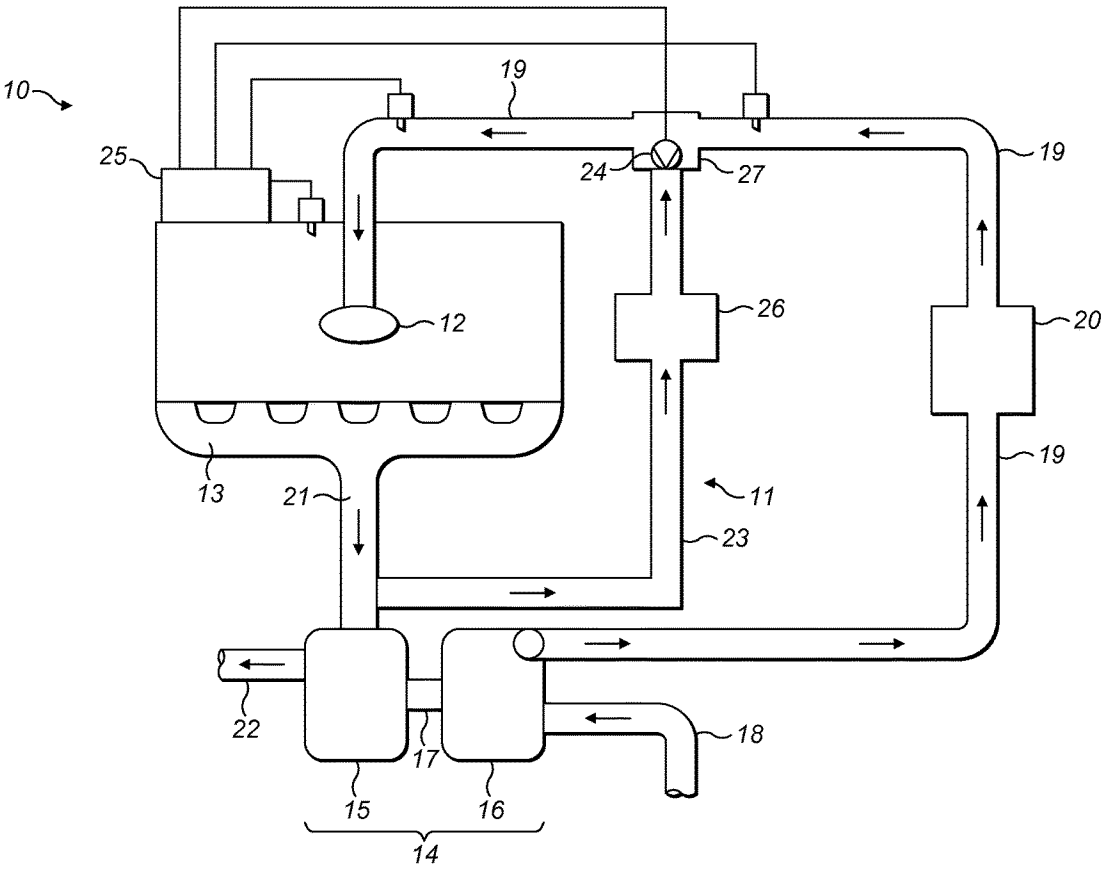
FIG. 1 is a schematic of an internal combustion engine with an exhaust gas recirculation system.

Referring to FIG. 1, there is shown an exemplary engine 10 having a high pressure loop exhaust gas recirculation system, EGR system 11. The engine 10 may be any kind of suitable engine, such as an internal combustion engine and in particular a diesel fuelled compression-ignition (CI) internal combustion engine. The internal combustion engine 10 may include a plurality of combustion cylinders housed in a crankcase. The combustion cylinders may be fluidly coupled with an intake manifold 12 and with an exhaust manifold 13. Whilst single intake and exhaust manifolds 12, 13 are shown in FIG. 1, it should be understood that more than one intake or exhaust manifold 12, 13 may be used, with each intake or exhaust manifold 12, 13 coupled to a plurality of combustion cylinders. A fuel, such as diesel fuel, or fuel air mixture may be introduced into each combustion cylinder 12 and combusted therein, in a known manner.

The engine 11 may further comprise a turbocharger 14. The turbocharger 14 may include a turbine 15 and a compressor 16 drivably connected by a common shaft 17. The compressor 16 may receive fresh air or gas via an air intake passage 18, which is compressed and supplied to the intake manifold 12 of the engine 10 via an air supply passage 19. The compressed "intake air", also known as charge air, may be passed through a charge air cooler 20 before it passes into the intake manifold 12.

The turbine 15 may be fluidly connected with the exhaust manifold 13, by means of a first exhaust passage 21, and to an exhaust system (not shown) of engine 10, by means of a further exhaust passage 22. The exhaust system may include an after treatment system, which removes combustion products from the exhaust gas stream, and one or more mufflers to dampen engine noise, before the exhaust gas is discharged to an ambient environment. The emission from the engine 12 is commonly referred to as exhaust gas, but may in reality be a mixture of gas, other fluids such as liquids, and even solids, comprising for example $CO_2$, $H_2O$, NOx and particulate matter. The after treatment system may include a diesel particulate filter, a diesel oxidation catalyst and/or a selective catalytic reduction system.

Although not shown in FIG. 1, the turbocharger 14 may be regarded as being a turbocharging arrangement comprising multiple turbochargers 14 in, for example, a series configuration.

In a naturally aspirated engine, the intake air which is supplied to the combustion chambers may not be compressed.

The EGR system 11 may comprise an EGR gas passage 23 which, in the case of a high pressure loop EGR system with a cold side EGR valve 24, fluidly connects the first exhaust passage 21 and the air supply passage 19, so that at least a portion of the exhaust gas may be mixed with the intake air and recirculated to the combustion cylinders. This portion of recirculated exhaust gas will be referred to herein as "EGR gas". The EGR system 11 may further comprise an EGR valve 24, which may be configured to be controlled by a controller 25 so as to vary the quantity of EGR gas flowing through the EGR gas passage 23. The EGR gas may be passed through an EGR cooler 26 to cool the EGR gas before it is mixed with the intake air. The order of the EGR cooler 26 and the EGR valve 24 may be reversed to give a hot side or a cold side EGR valve 24. The EGR system 11 may be designed as a single unit.

The controller 25 may be a single controller or comprise a plurality of independent or linked control units. The controller 25 may be configured to receive and process signals from various sensor arrangements and may be further configured to determine the operating conditions of the engine 10 and or the EGR system 11.

Figure 2:
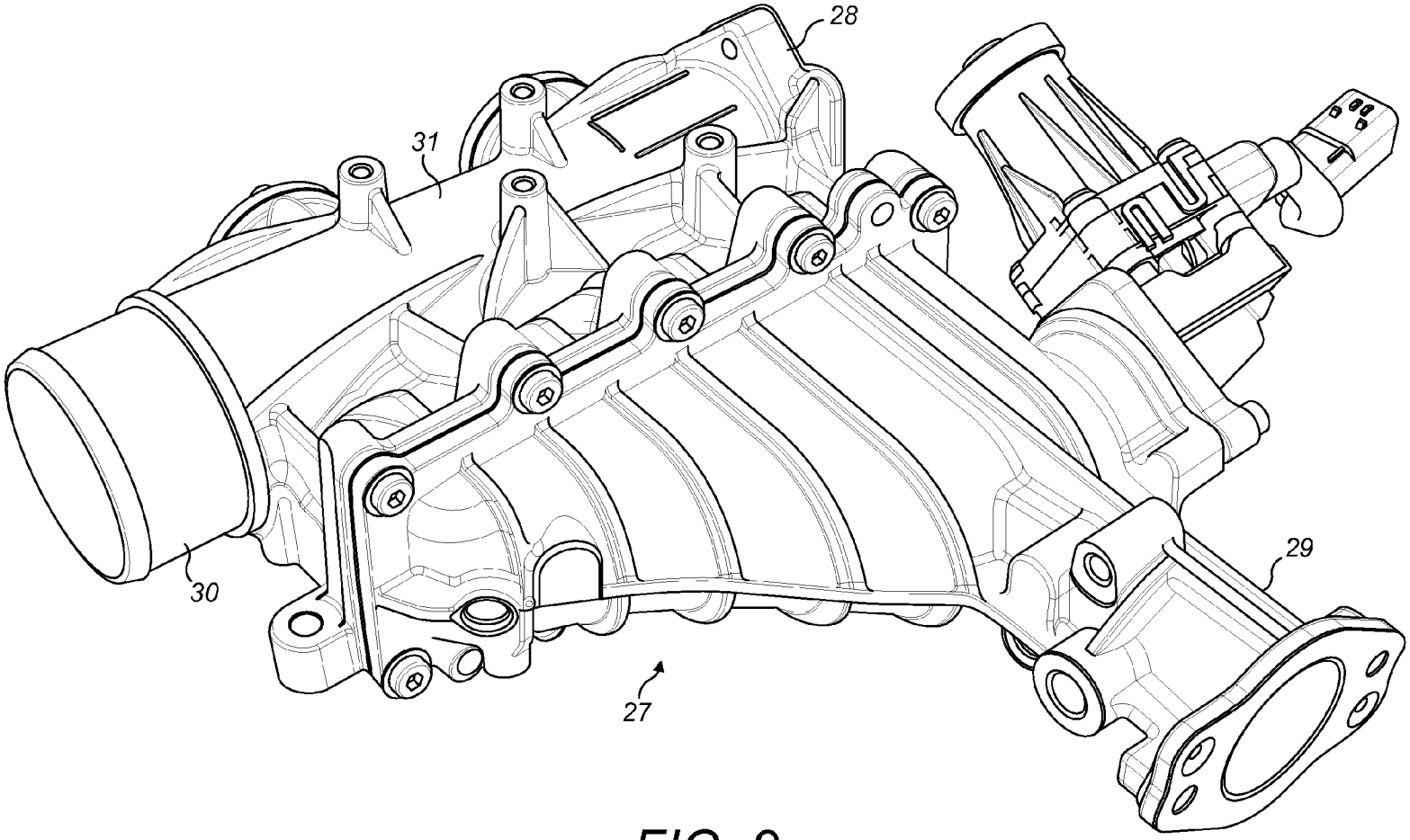
FIG. 2 is a perspective view of an exhaust gas recirculation mixer module of the exhaust gas recirculation system of FIG. 1.
Figure 3:
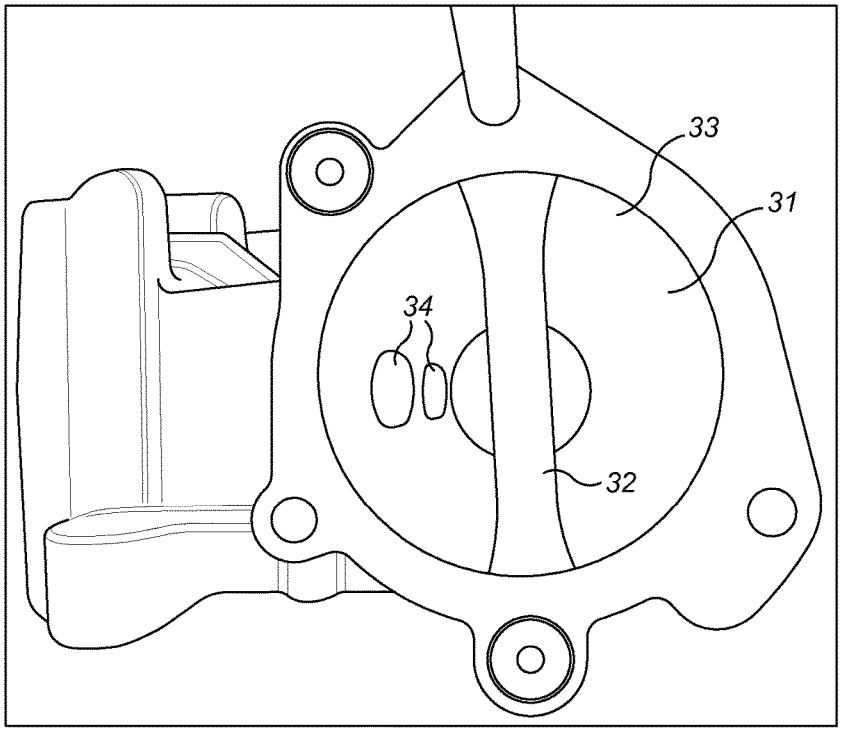
FIG. 3 is an end elevation of the exhaust gas recirculation mixer module of FIG. 2 showing the charge air inlet.
Figure 4:
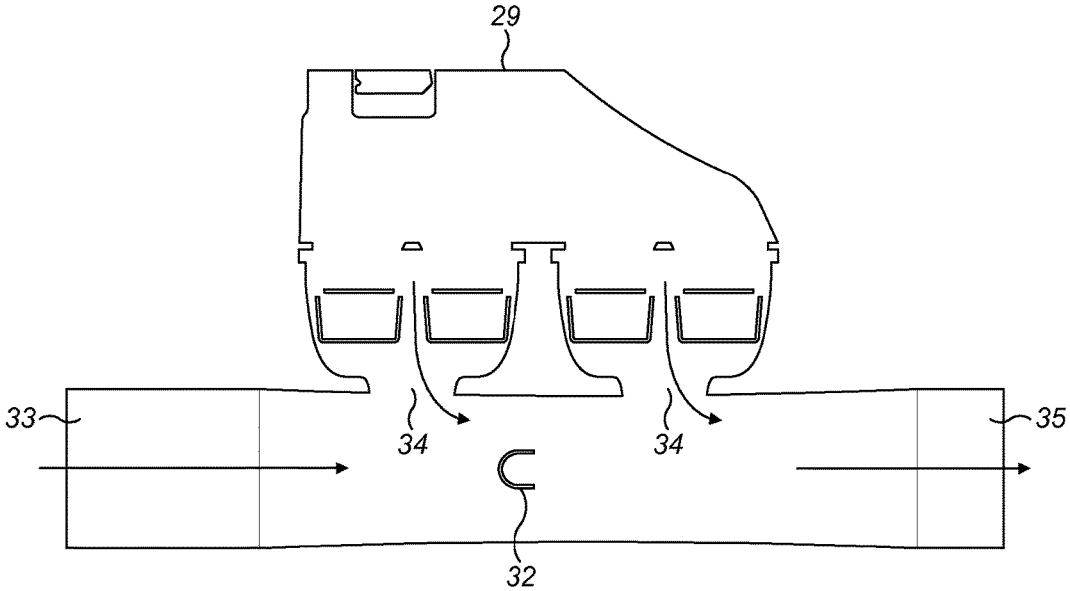
FIG. 4 is a cross sectional view of the exhaust gas recirculation mixer module of FIG. 2.

The EGR system 11 may further comprise an EGR mixer module 27 (see FIGS. 2 to 4). The EGR mixer module 27 comprises an intake air inlet 28, which may be fluidly connected with the air supply passage 19, and an EGR gas inlet 29, which may be fluidly connected with the EGR gas passage 23. Mixed EGR gas and intake air may pass out of the EGR mixer module 27 via an EGR mixer module outlet 30. The EGR mixer module outlet 30 may be fluidly connected to the intake manifold 12.

The EGR valve 24 may be located in the EGR mixer module 27 and may be configured to open or close off the EGR gas inlet 29 and the position of the EGR valve 24 may determine the flow rate through the EGR passage 23.

FIG. 3 shows the intake air inlet 28. A mixing chamber 31 extends from the intake air inlet 28 to the EGR mixer module outlet 30. The mixing chamber 31 therefore has a intake air inlet 33 with communicates with the intake air inlet 28 of the EGR mixer module 27; an EGR gas inlet 34, which may comprise one or more ports, which communicate with the EGR gas inlet 29 of the EGR mixer module 27; and an outlet 35 which communicates with the EGR mixer module outlet 30. The mixing chamber 31 may be substantially tubular and has a longitudinal axis extending in the direction of flow of the intake air. A mixing post 31 extends across the mixing passage 31. The mixing post 31 is located between the intake air inlet 33 and the EGR gas inlet 34, i.e. downstream of the intake air inlet 28 and upstream of the point at which at least some of the EGR gas, which enters the EGR mixing module 27 via the EGR gas inlet 34, meets the intake air. The mixing post 32 may be located upstream of one or more ports of the EGR gas inlet 34. As shown in FIGS. 3 and 4, the EGR gas inlet 34 may comprise two ports, each controlled by reed or other suitable valves.

The mixing post 32 is oriented so that its longitudinal axis is perpendicular to the longitudinal axis of the mixing chamber and also therefore the direction of flow of the intake air.

The mixing post 32 may have a C-shaped cross section as shown in FIG. 4. Alternatively it may be triangular, circular, D-shaped, elliptical. The mixing post 32 may also be in the form of an aerofoil which tapers in the direction of the intake air flow. The mixing post 32 may have a continuous deflection surface oriented towards the intake air inlet which is configured to disrupt the flow of intake air.

The dimensions of the mixing post may be selected according any one or all of to the Reynolds number of the intake air flow, the Strouhal number, fluid properties and the desired level of mixing of the EGR and intake gas streams.

The mixing chamber 31 may be die cast together with the mixing post as a single unit.

INDUSTRIAL APPLICABILITY

During operation of the engine 10, a fuel, such as diesel fuel, may be injected into the combustion cylinders and combusted. Exhaust gas produced as a result of the combustion process may be directed from the combustion cylinders to the exhaust manifold 13. At least a portion of the exhaust gas within the exhaust manifold 13 may be directed to flow through and drive the turbine 15. The spent exhaust gas may be discharged from the turbine 15 to atmosphere, via the exhaust system, before which it may be treated to reduce emissions. Another part of the exhaust gas, namely the EGR gas, may be directed to the EGR mixer module 27. The EGR gas may be cooled by the EGR cooler 26 before passing into the EGR mixer module 27 via the EGR gas inlet 29.

The turbine 15 may transmit power to the compressor 16 via turbocharger shaft 17. The compressor 16 may draw in fresh air or other gas and compress it. The compressed intake air may be discharged from the compressor 16 and may pass along the air supply passage 19 to the intake manifold 12 via the EGR mixer module 27. The compressed combustion gas may be cooled by charge air cooler 20 before passing into the EGR mixer module 27 via the intake air inlet 28.

When the EGR valve 24 is in a closed position, no EGR gas enters the EGR mixer module 27 and the intake air passes through the mixing passage 31 and out of the EGR mixer module outlet 30 to the intake manifold 12 for combustion.

When the EGR valve 24 is in an open position, EGR gas may enter the mixing chamber 31 of the EGR mixer module 27 via the EGR gas inlet 29 where it mixes with the clean intake air. The mixture may then be directed to the intake manifold 12 for combustion.

The stream of intake air flows past the mixing post 32 as it enters the mixing chamber 31 via the intake air inlet 33. The mixing post 32 may be configured to create turbulence, as the intake air is deflected by the surface of the mixing post 32. This may create a vortex sheet which creates a low pressure region downstream of the mixing post 32. This may enhance the penetration of the stream of EGR gas into the stream of intake air. Whilst the tangential components of the flow velocity are discontinuous across the vortex sheet, the normal component of the flow velocity is continuous. The EGR gas inlet 34 may also be configured to generate turbulence in the EGR gas stream, which may also be in the form of a vortex sheet. The vortex sheets meet and entwine perpendicular to each other along the main stream, causing the EGR and intake gasses to mix.

The use of a mixing post 32 may be advantageous in that only a relatively minor and inexpensive change is required in the manufacturing process to produce the mixing post 32. In particular, if the mixing chamber 31 is die cast, it is expected that the metal dies used in such a process may be easily modified to produce the mixing post 32.

The invention claimed is:

1. A mixing chamber for mixing exhaust gas with charge air in an engine, said mixing chamber comprising:

an intake air inlet configured to receive a flow of intake air;

an EGR gas inlet located downstream of the intake air inlet and configured to receive a flow of exhaust gas, the EGR gas inlet including one or more EGR gas inlet ports; and a mixing post located downstream of the intake air inlet and entirely upstream of at least one of the one or more EGR gas inlet ports, said mixing post extending across the mixing chamber, said mixing post having a longitudinal axis which is oriented perpendicular to a longitudinal axis of the mixing chamber, the mixing post being configured to create turbulence in the flow of intake air to mix the intake air with the flow of exhaust gas from said at least one of the one or more EGR gas inlet ports.

2. A mixing chamber as claimed in claim 1 in which the mixing post has a continuous deflection surface oriented towards the intake air inlet.

3. A mixing chamber as claimed in claim 2 in which the deflection surface is configured to disrupt the intake air flow.

4. A mixing chamber as claimed in claim 3 in which the mixing post has a cross section which is C-shaped, triangular, circular, D-shaped, elliptical or tapered.

5. A mixing chamber as claimed in claim 2 in which the mixing post has a cross section which is C-shaped, triangular, circular, D-shaped, elliptical or tapered.

6. A mixing chamber as claimed in claim 2 in which the mixing post and mixing chamber as cast as a single unit.

7. A mixing chamber as claimed in claim 1 in which the deflection surface is configured to disrupt the intake air flow.

8. A mixing chamber as claimed in claim 7 in which the mixing post has a cross section which is C-shaped, triangular, circular, D-shaped, elliptical or tapered.

9. A mixing chamber as claimed in claim 7 in which the mixing post and mixing chamber as cast as a single unit.

10. A mixing chamber as claimed in claim 1 in which the mixing post has a cross section which is C-shaped, triangular, circular, D-shaped, elliptical or tapered.

11. A mixing chamber as claimed in claim 1 in which the mixing post and mixing chamber as cast as a single unit.

12. A mixing chamber as claimed in claim 1 wherein the mixing post is configured to create a vortex sheet in the flow of intake air.

13. A mixing chamber as claimed in claim 12 wherein the vortex sheet creates a low pressure region downstream of the mixing post.

14. A mixing chamber as claimed in claim 13 wherein the low pressure region enhances the penetration of the exhaust gas flow out of the at least one EGR gas inlet port into the turbulent flow of the intake air.

15. A mixing chamber as claimed in claim 1 wherein the mixing post and the at least one of the one or more EGR gas inlet ports disposed downstream of the mixing post are configured to provide that exhaust gas flowing from the at least one of the one or more EGR gas inlet ports disposed downstream of the mixing post flows perpendicular to the turbulent flow of intake air generated by the mixing post.

16. A mixer module for mixing exhaust gas with charge air in an engine, the mixer module comprising:

an intake air inlet configured to receive a flow of intake air;

an EGR gas inlet located downstream of the charge air inlet and configured to receive a flow of exhaust gas, the EGR gas inlet including one or more EGR gas inlet ports;

an outlet; and a mixing chamber as claimed in any one of the preceding claims which extends from the intake air inlet to the outlet.

17. An internal combustion engine comprising the mixer module according to claim 16.

* * * * *